United States Patent [19]

Knudsen

[11] 4,332,835

[45] Jun. 1, 1982

[54] PLENUM MOUNTED GRID FOR ELECTROSTATIC FLUIDIZED BED

[75] Inventor: Walter G. Knudsen, Bethany, Conn.

[73] Assignee: Electrostatic Equipment Corp., New Haven, Conn.

[21] Appl. No.: 218,522

[22] Filed: Dec. 23, 1980

[51] Int. Cl.[3] ..... B05D 1/06

[52] U.S. Cl. ..... 427/32; 427/185; 118/624; 118/625

[58] Field of Search ..... 427/27, 32, 185; 118/309, 629, 630, 638, 624, 625

[56] References Cited

U.S. PATENT DOCUMENTS 4,051,809 10/1977 Zickar et al. ..... 118/630

4,101,687 7/1978 Knudsen ..... 427/27

*Primary Examiner*—John H. Newsome

[57] ABSTRACT

An apparatus, system and method are provided for the fluidized bed electrostatic coating of workpieces, especially those of continuous length, such as metal wires. The apparatus includes a control grid spanning the plenum chamber and establishing an electrical effect by which deposits of improved uniformity can be produced at lower operating voltages.

21 Claims, 4 Drawing Figures

PLENUM MOUNTED GRID FOR ELECTROSTATIC FLUIDIZED BED

BACKGROUND OF THE INVENTION

Electrostatic fluidized bed coating is, of course, a conventional and widely used technique for depositing particulate materials upon a great diversity of workpieces. Typical of the apparatus used for that purpose are the devices disclosed in Knudsen U.S. Pat. No. 3,916,826 and in Karr U.S. Pat. No. 4,030,446. While electrostatic coating with such devices is highly efficient, effective and safe, fluidized bed coating in general is not without its limitations and difficulties.

A particularly difficult problem relates to the attainment of uniform deposits upon all surfaces of the articles being coated. Such problems are due in part to the effects of the workpiece configuration upon the nature of the coating produced. Thus, a non-uniform workpiece will tend to develop an irregular deposit, particularly when, for example, the article has sharp edges or elements of relatively small dimension. But even when the workpiece is of entirely uniform configuration and is free of edges (e.g., when it is a length of round wire), the proximity of other workpieces will usually have an effect. Thus, when a plurality of wires are coated simultaneously, stopping or removing one of them will usually significantly change the characteristics of the deposit produced upon the others. This is highly undesirable in an automated operation, such as is, as a practical matter, necessary in the commercial production of insulated wire. But even when only one wire is involved, still a problem exists in producing the high degree of uniformity, from point to point along the full length of the wire, required for certain applications.

In those instances in which coatings are produced upon articles moving horizontally (or substantially so) above or through a fluidized bed, the difficulty of producing uniformity is compounded by the fact that rarefaction occurs upwardly within the cloud. As a result, the upper surfaces of the articles are exposed to less powder than are the lower portions, and therefore the deposits developed thereon tend to be thinner. The generally upward movement of the particles of the cloud, under the influence of the gas passing upwardly through the porous support plate of the fluidized bed, also favors the development of heavier coatings on lower surfaces.

Attempts have been made to compensate for the foregoing characteristics of electrostatic fluidized bed coating, such as through the use of appropriate masking devices to block those surfaces which would otherwise tend to receive disproportionately large amounts of the powder. Similarly, in Westervelt et al U.S. Pat. No. 4,011,832, build control means is disclosed for the purpose of selectively achieving either a uniform or a nonuniform deposit upon a workpiece, the invention being directed in particular to wire coating. While that approach has considerable merit, it nevertheless involves complexity of design, and tailoring of the equipment to a specific application.

Another difficulty which is inherent in powder coating entails the need for control, so as to minimize the waste of powder and to avoid creating an unhealthy and hazardous work environment. In some instances, these objectives are accomplished by the collection and recirculation of the coating powder, such as with a system of the sort disclosed in Carlson et al U.S. Pat. No. 4,123,175. While such systems are widely used, and are very effective, their installation does entail a considerable capital investment, and requires a significant amount of floor space. Problems of powder loss and contamination have also been dealt with through the use of electrodes, which are appropriately positioned with respect to the cloud and either grounded or charged to attract or repel fugitive particles. Such an approach is taught by Nakaya in U.S. Pat. No. 3,059,613, and by Point in U.S. Pat. No. 3,336,903. While such techniques may have merit, they do not provide the degrees of control and regulation necessary for convenient and effective operation as a practical matter, and especially not for purposes of coating wire on a commercial basis.

Many of the foregoing difficulties encountered in prior art apparatus and methods have been alleviated or avoided by the invention of Donald J. Gillette, set forth in U.S. Application for Letters Patent Ser. No. 114,656, filed on Jan. 23, 1980 and now issued as U.S. Pat. No. 4,297,386, which application is entitled CONTROL GRID IN ELECTROSTATIC FLUIDIZED BED COATER, and is of common assignment herewith. However, further improvement, especially in regard to uniformity of the coating along the length of a continuous length workpiece, are of course desirable.

Thus, it is a principal object of the present invention to provide a novel apparatus, system and method for electrostatic powder coating, by which workpieces, and especially wires of continuous length, can be coated with a high degree of uniformity in the thickness of the deposit from point-to-point along the length of the workpiece.

It is also an object of the invention to provide such an apparatus, system and method in which coating can be effected at reduced voltages, without loss of production speed.

Another object is to provide the foregoing by means that are relatively simple, inexpensive and convenient.

SUMMARY OF THE INVENTION

It has now been found that certain of the foregoing and related objects of the present invention are readily attained in electrostatic fluidized bed coating apparatus comprising, in combination, a housing having a generally planar, substantially horizontal porous support member mounted therein to define a fluidization chamber thereabove and a plenum therebelow. Means is provided for introducing gas into the plenum for passage upwardly through the support member to effect fluidization of particulate coating material supplied to the chamber, and additional means is provided for ionizing gas passing from the plenum into the fluidization chamber, to effect electrostatic charging of such material. The apparatus includes an electrically conductive control grid, which is mounted within and substantially across the plenum and which is effectively interposed between the support member and the ionizing means. The grid, which will normally be of mesh-like construction, is adapted for control of its electrical potential, and for substantially unimpeded passage therethrough of the ionized gas. As a result, the cooperative effects of fluidization and electrostatic charging may produce a cloud of electrostatically charged particulate material above the support member, and the plenum grid may be used to affect the deposition of powder upon a workpiece exposed to such a cloud.

In the preferred embodiments of the apparatus, high resistance means is included, through which the plenum grid may be electrically grounded. Most desirably, the grounding circuit includes a variable resistor, so as to enable facile adjustment of its electrical potential; typically, the resistance will be on the order of magnitude of megohms.

The apparatus of the invention is especially well suited for the coating of a multiplicity of workpieces of continuous length moving substantially horizontally therethrough, and accordingly, the housing of the apparatus will generally be adapted, or will have appropriate means, to permit such movement. The apparatus is particularly effective for coating metal wires, especially magnet wire, shaped conductors, and the like.

Certain other objects of the invention are readily attained in a system for electrostatically coating a continuous length workpiece. The system will include, in addition to fluidized bed coating apparatus having the features hereinabove described, means for conveying the workpiece therethrough at a location above the porous support member. Such a system will employ a fluidized bed having a housing which is adapted for movement therethrough of at least one workpiece of continuous length, for exposure to the cloud above the porous plate; generally, the system will be designed for the coating of a plurality of such workpieces, which will, in most instances, be horizontally moving wires.

Additional objects of the invention are readily attained in a method for depositing a particulate material upon a workpiece. The workpiece is exposed, at an effectively opposite potential, to a cloud of charged particles produced using an ionized gas, which gas has first been passed through an electrically conductive control grid. The control grid is maintained at an electrical potential substantially different from, and between the potentials of, the workpiece (normally grounded) and the gas ionizing electrode means. As a result, improved uniformity of deposit thickness, and/or higher powder deposition rates, may be achieved.

In preferred embodiments of the method, the grid potential is maintained by grounding through high resistance means, generally on the order of magnitude of megohms, and preferably having a value of at least 100 megohms. The method is most advantageously utilized when the workpiece is an article of continuous length, and will include a step of continuously moving the article through or proximate the cloud of charged particles, to produce a deposit of the particles thereon. Usually, such an article will be a metal wire, the rate of movement of which through the cloud will typically be about 10 to 100 feet per minute. Under such conditions, the deviation from average of the thickness of the coating along the length of the wire may be less than about 25 percent. This is especially so if the electrode means is charged to a potential of about 20 to 80, and preferably about 30 to 60, kilovolts.

DETAILED DESCRIPTION OF THE ILLUSTRATED EMBODIMENTS

Figure 1:
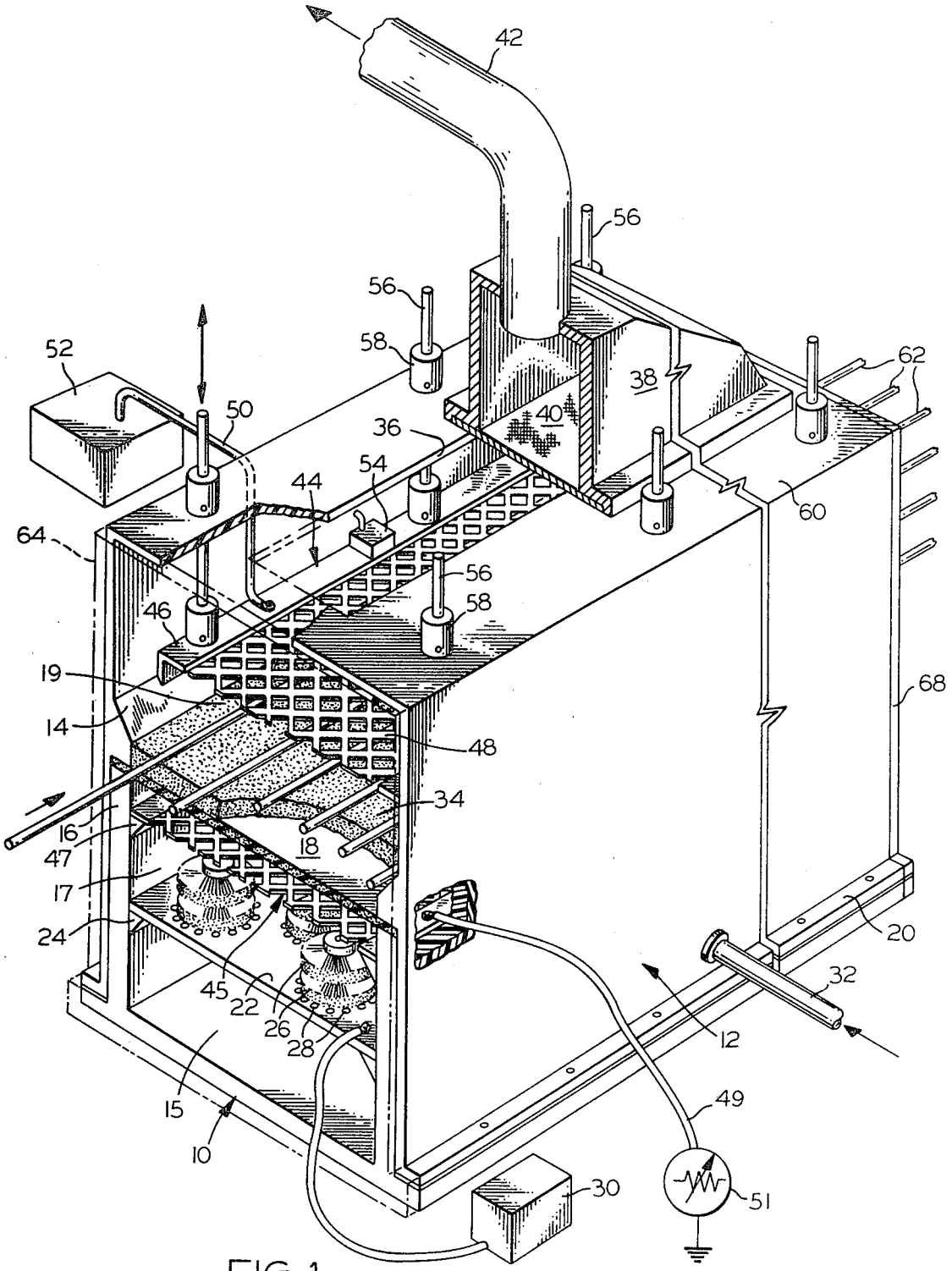
FIG. 1 is a foreshortened perspective view of an electrostatic fluidized bed coater embodying the present invention, with portions of the housing thereof being removed and broken away to expose the internal construction of the apparatus.

Turning now in detail to FIG. 1 of the drawings, therein illustrated is an electrostatic fluidized bed coater embodying the present invention and consisting of a bottom section and a top section, generally designated respectively by the numerals 10 and 12, which together provide the housing of the coater. As will be noted, the top section 12 is telescopically mounted upon the bottom section 10; they together support a porous support plate 18, by clamping its margins between the peripheral flange 14 (on the inner wall of section 12) and the upper edge of the sidewall 16 of the bottom section 10. The sections are bolted together through the peripheral flange 20, provided about the lower edge of the top section 12.

A conductive metal base plate 22 spans the bottom section 10, and is supported upon a peripheral shoulder 24, which extends about the inner surface of the sidewall 16 at a location approximately midway of its height. The plate 22 has a multiplicity of wire brush electrode structures 26 (only three of which are visable) mounted at spaced locations over substantially its entire surface, and it has formed therethrough numerous holes 28, adapted and positioned for the passage of air from the lower plenum chamber 15 beneath the plate 22, into contact with the ends of the bristles of the electrode structures 26, in the upper plenum chamber 17. High voltage is applied to the plate 22 from the source 30 thereof. The electrodes 26 are charged through electrical contact with the plate 22, to thereby ionize air passing through the pipe 32, into the lower plenum chamber 15, and thereafter into contact with the electrodes 26. Such apparatus is more fully described in the above-identified Karr patent, the relevant disclosure of which is hereby incorporated by reference; further description need not, therefore, be provided.

As is also taught in the Karr patent, the ionized air passes upwardly from the plenum chamber 17, through the porous support plate 18, and into the coating chamber 19, to thereby fluidize and electrostatically charge the powder 34, which is supported upon plate 18. In the present apparatus, the top section 12 of the housing has a rectangular central opening 36, over which is secured a hood 38. The opening 36 is covered by a porous filter member 40, and a gas conduit 42 provides communication between the hood 38 and a vacuum source (not illustrated). Accordingly, the air passing upwardly through the porous support plate 18 is withdrawn from the coating chamber 19 through the filter 40 and the conduit 42.

Disposed within the coating chamber 19, which is defined within the top section 12 above the porous plate 18, is a cloud control grid assembly, generally designated by the numeral 44, which conforms to the cross sectional configuration of the top section 12 of the housing and substantially spans the coating chamber 19. The assembly 44 consists of a frame 46 constructed of angle iron elements, within which is secured an expanded metal grid 48; it is connected through cable 50 to an electrical control device 52 (which will be more fully described hereinbelow), and it has mounted thereon a vibrating device 54. Secured to the upper surface of the frame 46 are six adjustment rods 56, which pass through collars 58 affixed upon the top wall 60 of the section 12 of the housing. Set-screws are provided in the collars 58, which may be loosened to permit movement of the rods 56 therethrough, to thereby accommodate vertical adjustment of the control grid assembly 44.

Figure 2:
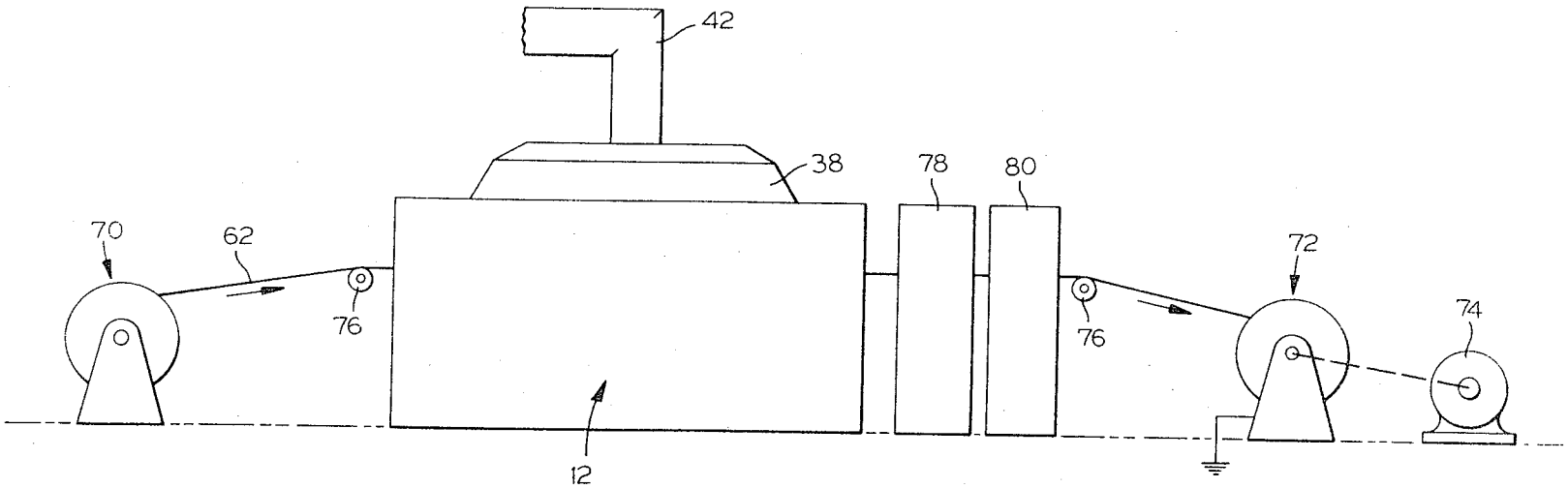
FIG. 2 is a diagrammatical elevational view of a wire coating system incorporating the coater of FIG. 1, drawn to a reduced scale.
Figure 3:
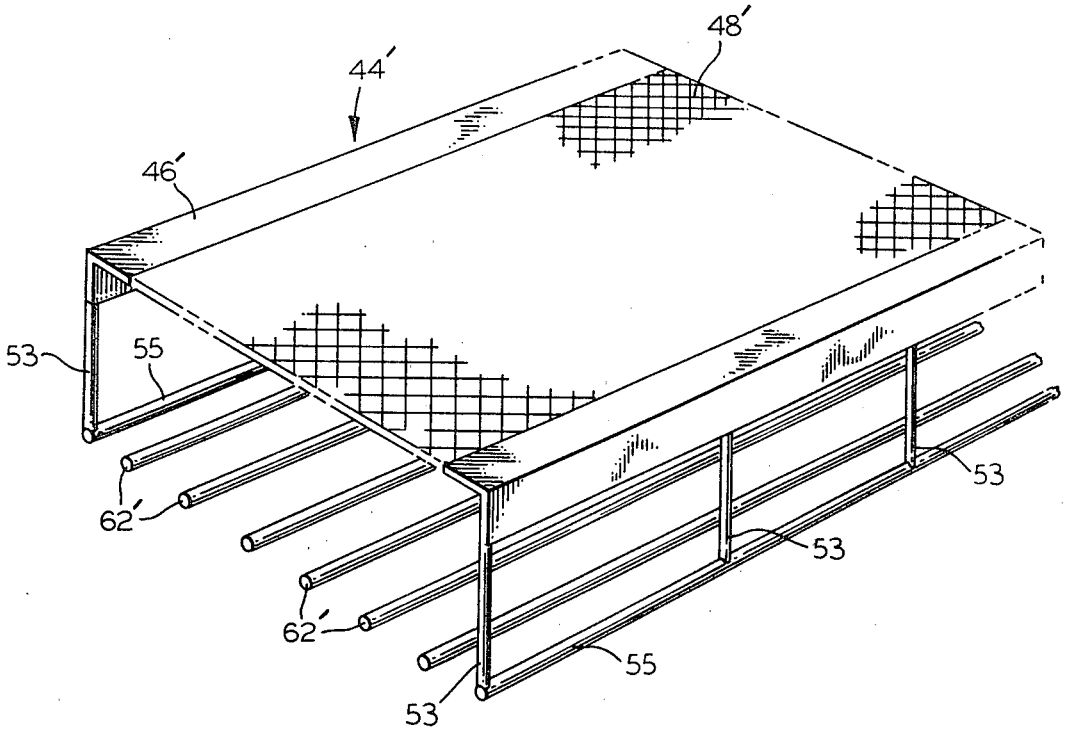
FIG. 3 is an enlarged, fragmentary perspective view of a modified form of the cloud control grid utilized in the coater.

Although not specifically illustrated, the construction of the grid 48 utilized in the assembly 44 is desirably such that it presents substantially no surface that is parallel to the general plane thereof, as is typical of expanded metal members (the "general plane" may be regarded to be that of the original metal sheet prior to its conversion to the expanded configuration). Accordingly, when the grid is disposed horizontally within the housing of the coater (as it will usually be in normal operation), virtually no horizontal surface will be presented thereby (by-and-large, the flat surfaces will be at a 45 degree angle to horizontal); hence, there will be very little tendency for the powder that passes through the grid 48 to collect thereupon. The vibrator 54 is provided to maintain the assembly 44 in constant agitation during operation, thereby continuously dislodging any particles of powder which may nevertheless deposit thereon (such as through electrostatic attraction), so as to further ensure that there will be no appreciable powder buildup. As will be understood, the accumulation of powder on the grid would be highly undesirable, in that clumps or agglomerates thereof, falling upon the articles during coating, would cause serious defects in the deposit. The angular attitude of the elements of the grid 48 of assembly 44 is shown in FIGS. 2 and 3 of the above identified application of Donald J. Gillette (Ser. No. 114,656); those figures, and the corresponding portions of the specification, are hereby incorporated by reference hereinto.

Disposed beneath the porous plate 18, within the upper plenum chamber 17, is a second control grid assembly, generally designated by the numeral 45. The construction of the assembly 45 is substantially the same as that of the cloud control grid assembly 44 (exclusive of the angle-iron frame construction), and so need not be described in detail. It also conforms to and substantially spans the chamber 17 in which it is disposed. However, unlike the previously described, adjustably mounted grid, the assembly 45 is fixedly mounted upon a peripheral shoulder 47 (albeit that the mounting is advantageously nonpermanent, to facilitate access and change of position, should that be desired), and hence the frame construction is modified as indicated. The grid assembly 45 is connected to ground by cable 49 through a variable high resistance 51, as will also be more fully discussed hereinafter.

Six metal wires 62 are shown passing through the coating chamber 19 at a location above the porous plate 18; although it may be used for a single wire, generally the unit will be used to simultaneously coat a multiplicity of them, and more or less than six may be involved in any particular operation. It will be appreciated that the end walls 64, 68 of the housing (the removed wall 64 being shown in FIG. 1 in phantom line) will have horizontally registered elongated slots formed therein, to permit passage of the wires therethrough.

Turning now to FIG. 2, the coating unit shown therein is that which was described in detail in connection with FIG. 1, and so need not be discussed further. Diagramatically shown therein are wire supply and takeup rolls, generally designated respectively by the numerals 70 and 72. As will be apparent, the multiple strands of wire 62 are played off from the supply roll(s) 70 and are wound upon the takeup roll(s) 72 (shown here to be grounded, to effect grounding of the wires), after passing through the fluidization chamber of the coater. Drive means 74 for the takeup roll 72, and appropriate support means for the wires, such as the idler rolls 76, are also provided, as are means 78 for heating the wire and/or the deposit (to effect fusion of the latter) and means 80 for cooling (and thus hardening) the coating subsequent to fusion. Although not illustrated, powder feed means will, of course, also be included in a typical system. As will be appreciated, FIG. 2 is intended only to be illustrative of a wire coating system of the sort for which the fluidized bed coater disclosed herein is particularly well adapted, and should not be regarded as limiting.

In operation of the system, a cloud of electrostatically charged particles will be generated above the porous plate 18, and the grounded wires 62 will attract and hold the particles during conveyance through the cloud, thus producing a deposit thereupon. Because the plenum grid assembly 45 is grounded through very high resistance, its potential will be highly negative (with respect to ground), but less negative than the base plate 22 and the electrodes 26 thereon. As a result, it is found that, although a greater amount of current (still on the order of magnitude of milliamperes) is drawn by the plate 22 and electrodes 26, the voltage required for a given rate of powder deposition upon the wires 62 is reduced significantly. For example, whereas, in the absence of the assembly 45, a potential of 70 kilovolts may be needed to produce a nominal thickness of 4 mils of powder upon a round wire moving through the coater at the rate of about 30 feet per minute, the presence of the grid 45 (grounded through a 200 megohm resistance) effects a reduction, to 50 kilovolts, of the potential on the electrodes 26 required to coat at the same rate. Under such circumstances, the grid 45 will normally have a potential of 30 to 40 kilovolts, and of the same sign (generally negative with respect to earth) as the gas ionizing structure.

It is surprisingly found that the coatings produced using the plenum grid are significantly more uniform, from point-to-point along the length of the wire, than are those produced in its absence. Thus, while the tolerance (i.e., the variation from nominal, or average, thickness) may be 25 percent or higher without the grid, its use results in a coating in which the variation may be 15 to 20 percent or less. The achievement of such improved uniformity is a primary benefit of the invention; the fact that it is accompanied by a substantial reduction in the ionization voltage demand is, of course, an added significant advantage.

Perhaps it should be emphasized that the advantages stemming from the use of the plenum grid assembly 45 are realized regardless of whether or not the cloud control grid assembly 44 is present or employed. However, concurrent use thereof further improves operation of the unit, and enables a high degree of control to be exercised in producing deposits of optimal quality and character.

With more particular reference now to the cloud control grid assembly 44, the effects that it produces are largely dependent upon the electrical control device 52 to which it is connected. In the simplest case, the device 52 may constitute a connection to ground, albeit that a rheostat is preferably included in the grounding circuit.

With such an arrangement, the grid 48 will draw the charged particles to a height above that to which they would otherwise rise, thereby densifying and regulating the cloud, and producing a high degree of uniformity therein. As a result, all surfaces of the grounded wires 62 will be exposed to substantially the same concentration of powder, and will therefore acquire a deposit which is uniform throughout.

In those instances in which the device 52 includes a rheostat, the electrical effect produced by the grid 48 upon the cloud can be altered by adjusting resistance, so as to vary the rate of charge conductance from the grid; the effect can also be altered by vertical adjustments of the assembly 44. In either instance, the strength of the field produced by the grid is changed, with the height and density of the cloud being affected commensurately. In any event, because of the potential of the grid, the particles tend to be confined below it. Air, of course, passes through the grid unimpeded, and is removed from the coater under the vacuum imposed; the filter 40 serves to remove from the air stream any particles that may be entrained therein, and thereby carried through the grid. Thus, the combined effects of the two grid assemblies 44, 45 will be a substantial enhancement of coating efficiency and uniformity, at lower applied voltages to the assembly 45.

Additional desirable results are achieved by impressing a voltage upon the cloud control grid 48 of assembly 44 (in which event the device 52 may constitute a D.C. power supply), or by grounding it; thus, the voltage may typically vary from positive to negative values (with respect to earth) of about 20 kilovolts, inclusive. In addition to producing densification and stabilization of the particle cloud, adjustment of the potential of the grid 48 may affect the spatial characteristics of the cloud, enabling it to be shifted, in effect, in a vertical sense. Thus, differentials may be produced in the thickness of the coating from top-to-bottom on the workpiece, or differentials otherwise caused may be compensated for, so as to achieve a deposit of ultimate uniformity.

Finally, and regardless of whether or not a voltage is applied, a cyclical electrical current may be impressed upon the grid assembly 44 to induce yet other changes in the nature and/or configuration of the cloud. In that event, the device 52 may include or constitute a signal generator or comparable device, by which may be applied low voltage (e.g., 50 volts) sine or square wave A.C. signals, or pulsating D.C. signals, at frequencies typically ranging from about 60 cycles to 30 kilocycles per second. The most readily observed consequence of such frequency effects appears to be enhanced levels of densification and stabilization of the cloud, although other results may also be produced thereby.

Hence, by adjusting the relative positions of the two grid assemblies 44, 45, while altering the value of the resistance 51 in the line of the plenum grid assembly 45, and the nature and value of the electrical control device 52 connected to the assembly 44, a high degree of control may be exerted upon the character and quality of the could that is developed within the coating chamber 19. This is, moreover, achieved while maintaining the improved uniformity of deposition of powder upon the workpiece that results from use of the plenum grid, as described above.

A particular benefit, which is attributable to the regulating influence that the grid 48 has upon the cloud of particles, resides in the facility with which changes in workpiece presence may be made during operation. Thus, it is found that, with the grid 48 at a suitable potential and in an appropriate position within the coating chamber, workpieces may readily be introduced, removed, or conveyed at a changed speed, with very little if any effect upon the nature and quality of the deposits produced upon other objects being coated. This is of particular importance for commercial operations, in which the avoidance of a need to shut down a system to accommodate, for example, the breakage of a wire, is of great advantage.

Figure 4:
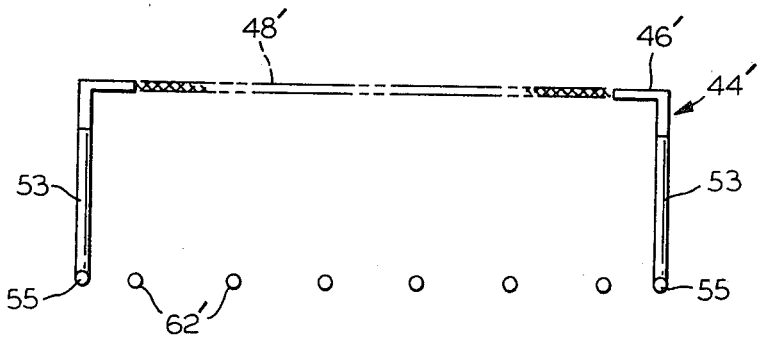
FIG. 4 is a front elevational view of the grid of FIG. 3.

The modification illustrated in FIGS. 3 and 4 of the drawings relates to the same general effect, and provides yet a further measure of control of the coating operations. More particularly, the modified grid assembly depicted therein, generally designated by the numeral 44', is of essentially the same construction as that of assembly 44 shown in FIG. 1, and includes angle iron frame members 46' and a mesh like grid 48' (diagrammatically illustrated). Depending from the longitudinally extending transverse edge at each side of the frame are a plurality of electrically conductive posts 53, and a longitudinally extending, rectilinear electrical conductor 55 is supported from the lower ends of the several posts 53 aligned along the corresponding side of the assembly 44'. As will be noted, the conductors 55 are parallel to and substantially in the horizontal plane of the several wires 62' moving through the coating unit (not shown), in which the grid assembly 44' is installed.

Since the conductors 55 will be at the same electrical potential as the remainder of the assembly 44', the cloud-regulating effect thereof will be extended to the level of the wires 62', at locations directly adjacent the outermost ones thereof. As a result, the conductors 55 function as though they were additional wires, stationarily disposed so as to regulate the effect upon the two outermost wires actually being coated. Whereas, as previously noted, the unmodified grid minimizes or moderates the effect of changes in the total workpiece mass or configuration, the degree of protection afforded to the outermost wires (which are unprotected on one side by an adjacent wire) is not entirely satisfactory in certain instances. The modified grid assembly 44' effectively corrects any deficiency in that respect.

Although not illustrated, it should be appreciated that the posts 53 (or other elements of the grid assembly 44') may be electrically insulating, with the electrical effect applied to the conductors 55 being different from that on the grid 48'. As a result, even further control of the nature and configuration of the cloud can be afforded, by means and variants that will be evident to those skilled in the art, in view of the foregoing descriptions and information.

Generally, the cloud control grid will be positioned within the coating chamber in rather close proximity to the workpiece and, in any event, below the level to which the charged particle cloud would normally ascend in the absence of the grid. Because of this, the grid should be of relatively dense and yet open construction, to enable the establishment of adequate field intensities without the creation of undesirable air currents, such as would tend to be produced if, for example, a solid plate were use; this would promote nonuniformity and thereby compromise a primary benefit of the invention. The plenum grid must be of open construction, so as to enable the ionized gas to pass substantially unimpeded therethrough. Excessive interference would be disadvantageous not only from the standpoint of fundamental pressure and flow considerations, but also because of the deionizing effect that would be engendered. The position of the grid within the plenum does not appear to be critical, as long as it is so disposed as to efficiently affect the charging gas in the desired manner, while avoiding arcing, such as to the brush electrodes 26. However, it should be appreciated that the potential of the plenum grid will be a function of its distance from the ionized gas source, as well as of the amount of resistance in the grounding circuit. Typically, the plenum grid will be spaced about 3 to 20 centimeters above the charging electrodes, in the type of unit illustrated.

As noted, both control grids should substantially span their respective chambers; however, some open areas may be present for special purposes or effects. Moreover, it may be advantageous to define isolated, independently controllable regions of the grids, so as to enable different electrical effects to be established across the bed. Also, it may be desirable, in some instances, to vertically stack two or more grids in each zone of the bed, since doing so may afford the ultimate measure of control.

Although particular emphasis has been placed upon the application of the various embodiments of the invention to the coating of articles of continuous length, it will be appreciated that the concepts hereof are not limited thereto, and may be applied with comparable advantage to the coating of numerous other discrete workpieces. Moreover, it should be understood that coating of a variety of continuous length articles is contemplated, including round and rectangular wire, metal strip, screen, and the like, with appropriate modifications being made to accommodate and most effectively coat whatever type of workpiece is involved.

Thus, it can be seen that the present invention provides a novel apparatus, system and method for electrostatic powder coating, by which workpieces, and especially wires of continuous length, can be coated with a high degree of uniformity in the thickness of the deposit from point-to-point along the length of the workpiece. The invention also provides such an apparatus, system and method in which coating can be effected at reduced voltages, without loss of production speed, and the foregoing are provided by means that are relatively simple, inexpensive and convenient.

Having thus described the invention, what is claimed is:

1. Electrostatic fluidized bed coating apparatus comprising, in combination: a housing having a generally planar, substantially horizontal porous support member mounted therein to define within said housing a fluidization chamber thereabove and a plenum therebelow; means for introducing gas into said plenum for passage upwardly through said support member to effect fluidization of particulate coating material supplied to said chamber; means for ionizing gas passing from said plenum into said fluidization chamber, to effect electrostatic charging of such particulate material; and an electrically conductive, open structured control grid mounted within and substantially across said plenum effectively interposed between and spaced from said support member and said ionizing means, said grid being adapted for control of its electrical potential and for substantially unimpeded passage therethrough of the ionized gas, whereby the cooperative effects of fluidization and electrostatic charging may produce a cloud of electrostatically charged particulate material above said support member, and whereby said plenum grid may be used to affect the deposition of powder upon a workpiece exposed to such cloud.

2. The apparatus of claim 1 additionally including high resistance means through which said plenum grid may be electrically grounded, and wherein said grid is of mesh-like construction.

3. The apparatus of claim 2 wherein the grounding circuit of said grid includes a variable resistor, so as to enable facile adjustment of the electrical potential of said grid.

4. The apparatus of claim 2 wherein said resistance means has a value on the order of magnitude of megohms.

5. The apparatus of claim 1 wherein said housing is adapted for substantially horizontal movement therethrough of at least one workpiece of continuous length.

6. The apparatus of claim 5 wherein said housing is adapted for passage therethrough of a multiplicity of such workpieces.

7. The apparatus of claim 6 wherein said workpieces are metal wires.

8. A system for electrostatically coating a continuous length workpiece, including:

(a) electrostatic fluidized bed coating apparatus comprising, in combination, a housing having a generally planar, substantially horizontal porous support member mounted therein to define within said housing a fluidization chamber thereabove and a plenum therebelow; means for introducing gas into said plenum for passage upwardly through said support member to effect fluidization of particulate coating material supplied to said chamber; means for ionizing gas passing from said plenum into said fluidization chamber, to effect electrostatic charging of such particulate material; and an electrically conductive, open structured control grid mounted within and substantially across said plenum effectively interposed between and spaced from said support member and said ionizing means, said grid being adapted for control of its electrical potential and for substantially unimpeded passage therethrough of the ionized gas, said housing being adapted for the movement therethrough of at least one workpiece of continuous length for exposure above said support member, whereby the cooperative effects of fluidization and electrostatic charging may produce a cloud of electrostatically charged particulate material above said support member, and whereby said plenum grid may be used to affect the deposition of powder upon a workpiece exposed to such cloud; and (b) means for continuously conveying a workpiece of continuous length through said housing of said apparatus for exposure to the cloud above said support member.

9. The system of claim 8 wherein said conveying means is adapted to convey a multiplicity of such continuous length workpieces simultaneously through said housing.

10. The system of claim 8 wherein said housing and conveying means are adapted for substantially horizontal movement of said workpiece through said housing at a location above said support member.

11. In a method for depositing a particulate material upon a workpiece, wherein ionization of a gas is effected by exposing it to electrode means maintained at a high electrical potential, said ionized gas is passed through a substantially horizontal porous plate on which is supported a bed of particles to effect fluidization and electrostatic charging, so as to thereby produce a charged cloud thereof, and wherein the workpiece is maintained at a potential effectively opposite to that of said particles and is exposed thereto, the improvement comprising: passing, substantially without impediment, said ionized gas through an upwardly spaced electrically conductive control grid before passing it through said porous plate, with said grid maintained at an electrical potential substantially different from, and between the potentials of, said workpiece and the gas ionizing electrode means, whereby improved uniformity of deposit thickness, and/or higher powder deposition rates, may be achieved.

12. The method of claim 11 wherein said electrical potential of said grid is maintained by grounding said grid through high resistance means having a value on the other of magnitude of megohms.

13. The method of claim 12 wherein said high resistance means has a value of at least 100 megohms.

14. The method of claim 11 wherein said workpiece is grounded.

15. The method of claim 14 wherein said workpiece is an article of continuous length, and wherein said method includes the step of continuously moving said article through or proximate said cloud of charged particles, to produce a deposit of said particles thereon.

16. The method of claim 15 wherein said article is a metal wire.

17. The method of claim 16 wherein the rate of movement of said wire through said cloud is about 10 to 100 feet per minute.

18. The method of claim 11 wherein said gas is ionized by passing it into contact with electrode means, said electrode means being charged to a potential of about 20 to 80 kilovolts.

19. The method of claim 18 wherein said electrode means potential is about 30 to 60 kilovolts.

20. The method of claim 15 wherein said workpiece is moved substantially horizontally through or proximate said cloud.

21. The method of claim 15 wherein the deviation from average of the thickness of the coating along the length of said article is less than about 25 percent.

* * * * *